US005191349A

United States Patent [19]

Dinsmore et al.

[11] Patent Number: 5,191,349

[45] Date of Patent: Mar. 2, 1993

[54] APPARATUS AND METHOD FOR AN AMPLITUDE MONOPULSE DIRECTIONAL ANTENNA

[75] Inventors: Bruce E. Dinsmore, Glendale; Mark D. Smith, Phoenix, both of Ariz.

[73] Assignee: Honeywell Inc., Minneapolis, Minn.

[21] Appl. No.: 564,430

[22] Filed: Aug. 8, 1990

[51] Int. Cl.[5] ..... H01Q 1/40; H01Q 3/24; H01Q 3/28; H01Q 21/06

[52] U.S. Cl. ..... 343/751; 343/826; 343/841; 343/853; 343/872

[58] Field of Search ..... 343/789, 872, 705, 749, 343/751, 752, 826, 841, 853; 342/368

[56] References Cited

U.S. PATENT DOCUMENTS

| | | | |
|---|---|---|---|
| 3,569,971 | 3/1971 | Griffee | 343/789 |
| 4,540,988 | 9/1985 | Munk et al. | 343/789 |
| 4,682,181 | 7/1987 | Dumas et al. | 343/789 |
| 4,791,429 | 12/1988 | Hannan | 343/789 |
| 5,039,994 | 8/1991 | Wash et al. | 343/841 |

*Primary Examiner*—Michael C. Wimer

*Attorney, Agent, or Firm*—D. E. Jepsen; D. Lenkszus; A. Medved

[57] ABSTRACT

A directional antenna suitable for use with the transmission and reception of information related to the traffic alert and collision avoidance systems (TCAS) of a monitoring aircraft is disclosed. The directional antenna includes four monopole antennas positioned and electrically coupled in a manner to produce a radiation pattern having unique directional characteristics. The disclosed antenna can transmit radiation in a directional pattern. The antenna can also receive radiation from a transponder equipped intruder aircraft (i.e., an aircraft within a predetermined range of the monitoring aircraft). By comparing the amplitudes of the signals induced in the plurality of antenna elements by the received radiation, the bearing (direction) of the intruder aircraft relative to the monitoring aircraft can be determined. The antenna is fabricated to provide a reduced cross-sectional profile, for example by providing a folded monopole antenna structure, thereby reducing the antenna profile in aircraft applications.

3 Claims, 4 Drawing Sheets

APPARATUS AND METHOD FOR AN AMPLITUDE MONOPULSE DIRECTIONAL ANTENNA

BACKGROUND OF THE INVENTION

1. Field of the Invention

This invention relates generally to antennas and, more particularly, to a directional antenna used in the traffic alert and collision avoidance systems (TCAS) of aircraft avionics equipment. The antenna can transmit a directional radiation pattern to activate transponders of transponder-equipped aircraft in a vicinity of the aircraft. The antenna operating in a radiation receiving mode receives the radiation from transponder-equipped aircraft. In the preferred embodiment, the relative bearing or relative direction of the transponder-equipped intruder aircraft can be determined by comparison of the relative amplitudes of signals induced in the antenna elements of the monitoring aircraft. Typically, the two signals of greatest amplitude (in an antenna with four antenna elements) can provide the direction of an intruder aircraft, the antenna of the present invention having four antenna elements in the preferred embodiment.

2. Description of the Related Art

As technology in air transportation has evolved, the demands on the members of the flight deck have become increasingly severe. The flight deck must monitor increasing amounts of aircraft status information at a time when the air traffic is dramatically increasing. The aircraft speeds have similarly increased, reducing the time in which the flight deck can respond to threatening situations.

In order to assist the flight deck and provide an increased margin of safety in the air transport environment, several systems have been and are in the process of being developed. Aircraft are being provided with transponders (e.g., mode S, mode C, mode A, ATCRBS, etc.) by which one aircraft can communicate to a second aircraft both its identity and flight parameters. Typically, a monitoring aircraft will transmit a signal in a predetermined format which, upon receipt by an intruding aircraft will cause the intruding aircraft to respond with a transmission which includes information in a predetermined format. A series of systems have been and are being developed, generally referred to as traffic alert and collision avoidance systems (generally referred to as TCAS systems), in which the information provided to a receiving aircraft can be processed along with the status parameters of the receiving aircraft to identify potential collision situations. The traffic alert and collision and avoidance systems also provide the flight deck with advisory information suggesting an action to avoid the collision situation.

A key element in the mode S (and other) transponder systems and the traffic alert and collision avoidance systems is the directional antenna. The directional antenna is used to determine the bearing or direction of intruder aircraft relative to a TCAS-equipped monitoring aircraft. When the relative direction has been determined by the processing of radiation induced signals by the monitoring aircraft, this information can be visually displayed to the members of the flight deck and can assist them in obtaining visual contact with the intruder aircraft.

A need has therefore been felt for an antenna which can determine a direction from which radiation is being transmitted. The direction from which the radiation is being transmitted can be determined by the relative induced signal amplitudes at each of the antenna elements. In addition, the antenna should provide a minimum profile to reduce the drag associated with the antenna array, should be relatively simple to manufacture, and should be relatively impervious to environment hazards while maintaining the precise positional relationships between the antenna components.

FEATURES OF THE INVENTION

It is an object of the present invention to provide an improved antenna.

It is a feature of the present invention to provide an improved antenna for use in an aircraft.

It is another feature of the present invention to provide an improved amplitude monopulse directional antenna.

It is yet another feature of the present invention to provide an antenna which can transmit a directional radiation pattern.

It is still another feature of the present invention to provide an antenna which can identify the direction from which radiation is being generated.

It is a further feature of the present invention to provide an antenna in which a direction from which radiation is being transmitted can be determined by the amplitudes of signals induced in the antenna elements.

It is a still further feature of the present invention to provide an antenna in which a direction from which radiation is being transmitted can be determined without the use of phase information.

It is yet a further feature of the present invention to provide an antenna which can be easily fabricated.

It is still a further feature of the present invention to provide an antenna in which a plurality of monopole antenna elements have capacitive hats and in which each antenna element is a folded monopole antenna in order to provide a reduced profile.

It is a more particular feature of the present invention to include components for establishing that the processing apparatus is correctly coupled to the antenna and for identifying antenna failure conditions.

It is still another more particular feature of the present invention to minimize the vulnerability of the antenna to lightning.

It is another more particular object of the present invention provide an antenna in which the antenna elements are decoupled by a conducting region positioned therebetween.

SUMMARY OF THE INVENTION

The aforementioned and other features are attained, according to the present invention, by an antenna which includes a plurality of folded monopole antenna elements. The antenna elements are fabricated by applying a conductive coating to predetermined structures and regions on an interior surface of a dielectric radome. Electrical connectors are coupled to a beam forming network and the beam forming network is coupled to the antenna elements. The antenna elements are positioned and can be electrically driven to provide a directional radiation pattern in the transmission mode. In the receiving mode, the direction from which radiation is being transmitted can be determined by the relative amplitudes of the signals generated in the individual antenna elements as applied to the electrical connectors.

The antenna includes a dielectric radome to which conducting material has been applied on an interior surface. The structure of the radome and the regions to which the conducting material is applied results in a plurality of folded monopole antenna elements. The antenna elements are decoupled by a conducting region between the antenna elements. The folded monopole structure along with the use of capacitive hats permits generation of radiation of acceptable amplitude and the receipt of radiation with requisite sensitivity for transponder communication between aircraft. In addition, the folded monopole antenna elements permit the height of the radome housing the antenna to be reduced. The directional antenna is suitable for mode S transponder system and traffic alert and collision avoidance system inter-aircraft communication.

These and other features of the invention will be understood upon reading of the following description along with the drawings.

DESCRIPTION OF THE PREFERRED EMBODIMENT

1. Detailed Description of the Figures

Figure 1:
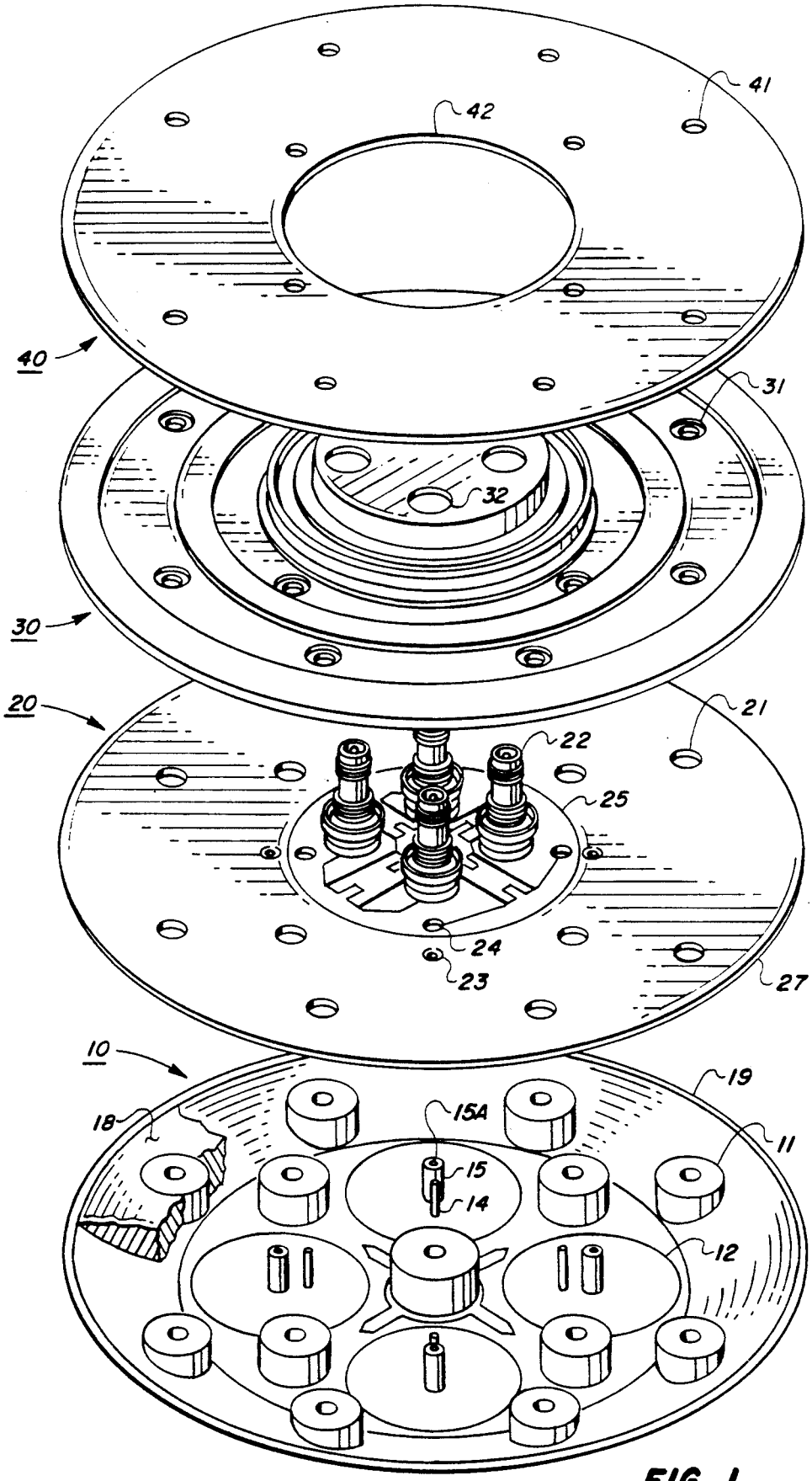
FIG. 1 is an exploded view of the antenna according to the the present invention.

Referring now to FIG. 1, an exploded view of the antenna 5 includes a radome assembly 10, a ground plate assembly 20, base plate 30, and adapter plate 40. A radome 19 is fabricated from injection molded 15% glass filled polyethersulfone resin, in the preferred embodiment. The radome 19 has fabricated on an interior surface various structures including fastening posts 11, grounded portions of the monopole antenna elements 15, and free portions of the monopole antenna elements 14. The fastening posts 11 are provided with recessed (i.e., with respect to the exterior portion of the radome) surfaces for engaging the fasteners which pass through apertures in the fastening posts and couple to the adapter plate 40 or to the aircraft. The monopole antenna element portions 14 and 15 are coated with copper directly on the surfaces thereof. The grounded antenna element portions 15 have threaded apertures 15A formed therein. Capacitive hats 12 are fabricated by coating copper directly on the interior surface of the radome 19. The copper coated antenna element portions 14 and 15 are in contact with the capacitive hats 12 to form folded monopole antenna elements. The central fastening post 11 and the surrounding region of the radome interior, the surrounding region extending at least partially between the folded monopole antenna elements, are coated with copper and provide for decoupling between the individual antenna elements. The radome assembly 10 is thereafter filled with rigid urethane foam 18 to provide structural support for the radome and the structures fabricated thereon.

The ground plate 20 includes a conducting plate 27 with apertures 21 formed therein. Apertures 21 are positioned to permit the passage therethrough of the fasteners coupling the antenna to the adapter plate 40 or to the aircraft. The apertures 23 are countersunk, in the preferred embodiment, and serve to position screws which pass therethrough to threaded apertures in the grounded antenna element portions 15A. A beam forming circuit card assembly 25 is mechanically coupled to the ground plate 27. Apertures 24 are positioned to permit the free antenna element portions 14 to extend therethrough the conducting plate 27 and through the beam forming circuit card assembly 25. The beam forming circuit card assembly is fabricated from microstrip artwork etched on a brass-backed Teflon (polytetrafluoroethylene) printed circuit board. The microstrip components include twelve capacitors and four resistors as well as appropriately dimensioned conducting strips. Coupled to the ground plate 20 and the coupled circuit card assembly 25 are four connectors 22 which electrically couple the processing and signal generating apparatus of the aircraft to the beam forming circuit on the circuit card assembly.

The base plate 30 provides structural support for the antenna. The base plate 30 includes apertures 31 through which pass the fasteners coupling the antenna to the adapter plate 40 or to the aircraft. The base plate 30 also includes apertures 32 through which pass the electrical connectors 22, the electrical connectors coupling the antenna 5 and the aircraft electrical apparatus.

The adapter plate 40 is used to adapt the antenna to any specified (aircraft) surface configuration. The adapter plates are structured to permit coupling screws to pass therethrough and to permit the connector 22 to pass therethrough. The multiplicity of fastening structures and associated apertures permit strong mechanical coupling to the (aircraft) support structure.

Figure 2:
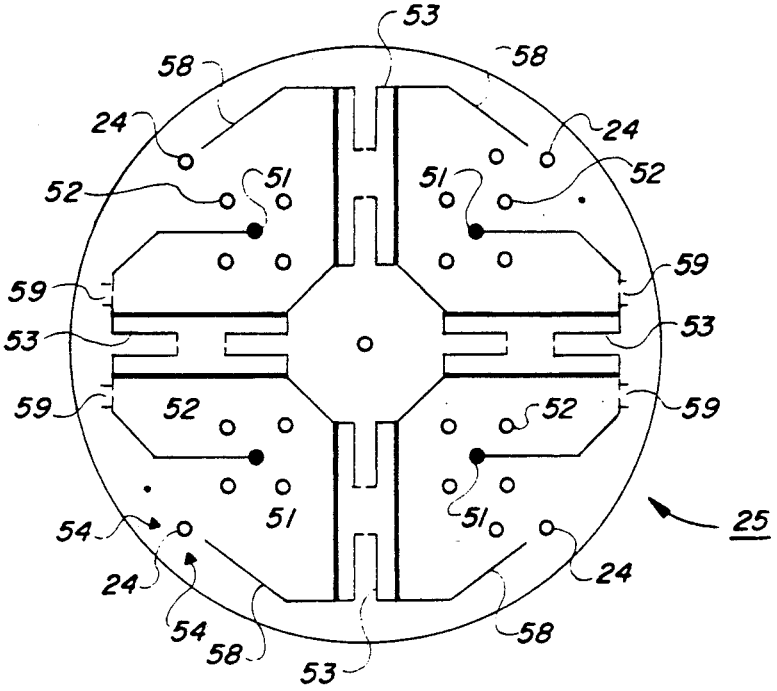
FIG. 2 is a diagram of the beam forming network for the antenna.

Referring now to FIG. 2, the components of the beam forming network 50 formed on the beam forming circuit card 25, according to the present invention, are shown. The arrows 54 indicate the forward direction of the antenna array. The terminals 51 are each coupled to one of the electrical connectors 22. Of the four power dividing components 53, two of the power dividing components positioned on opposite sides of the beam forming circuit network 50 center are coupled to two of the terminals 51. Each of the power dividing components coupled to the terminals 51 are coupled to the two remaining power dividing components 53. The two remaining output power dividing components are each coupled through a ¼ wave transformer 58 to a free antenna element portion extending through aperture 24. The ¼ wave transformer 58 to is coupled to the antenna element is accomplished by a contact (not shown). The conducting strip between each side of a power dividing component 53 includes a capacitor (shown as component 534 in FIG. 3). The capacitor is essentially a short circuit at operational frequencies and is used for test purposes. The components 59 are each a resistor and capacitor, coupled in parallel, each resistor having a different value. As with the capacitors described previously, the resistors and capacitors, coupled in parallel, are used for test purposes and do not affect the operation of the network.

Figure 3:
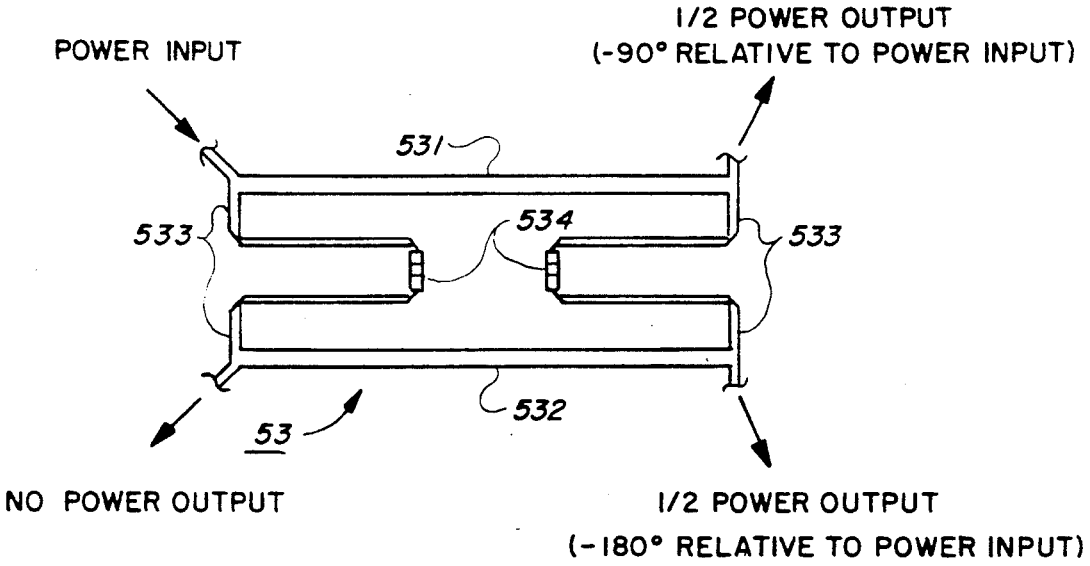
FIG. 3 illustrates the operation of the power divider circuit included in the beam forming circuit.

Referring next to FIG. 3, the operation of a power dividing component 53 is illustrated. The power dividing component 53 includes two parallel conducting strips 531 and 532. The ends of the conducting strips 531 and 532 are coupled by conducting strips 533. (The conductors 533 include the capacitors 534 which are used for test purposes). When input power P with 0° phase is applied to one end of a conducting strip 531, the second end of conducting strip 531 provides an output power ½P with −90° phase relative to the input power. The end of conducting strip 532 proximate the end of conducting strip 531 to which the power P has been applied provides no power output. The end of conducting strip 532, opposite to the end providing no power output, provides an output power of ½P with −180° phase relative to the input power.

Figure 4:
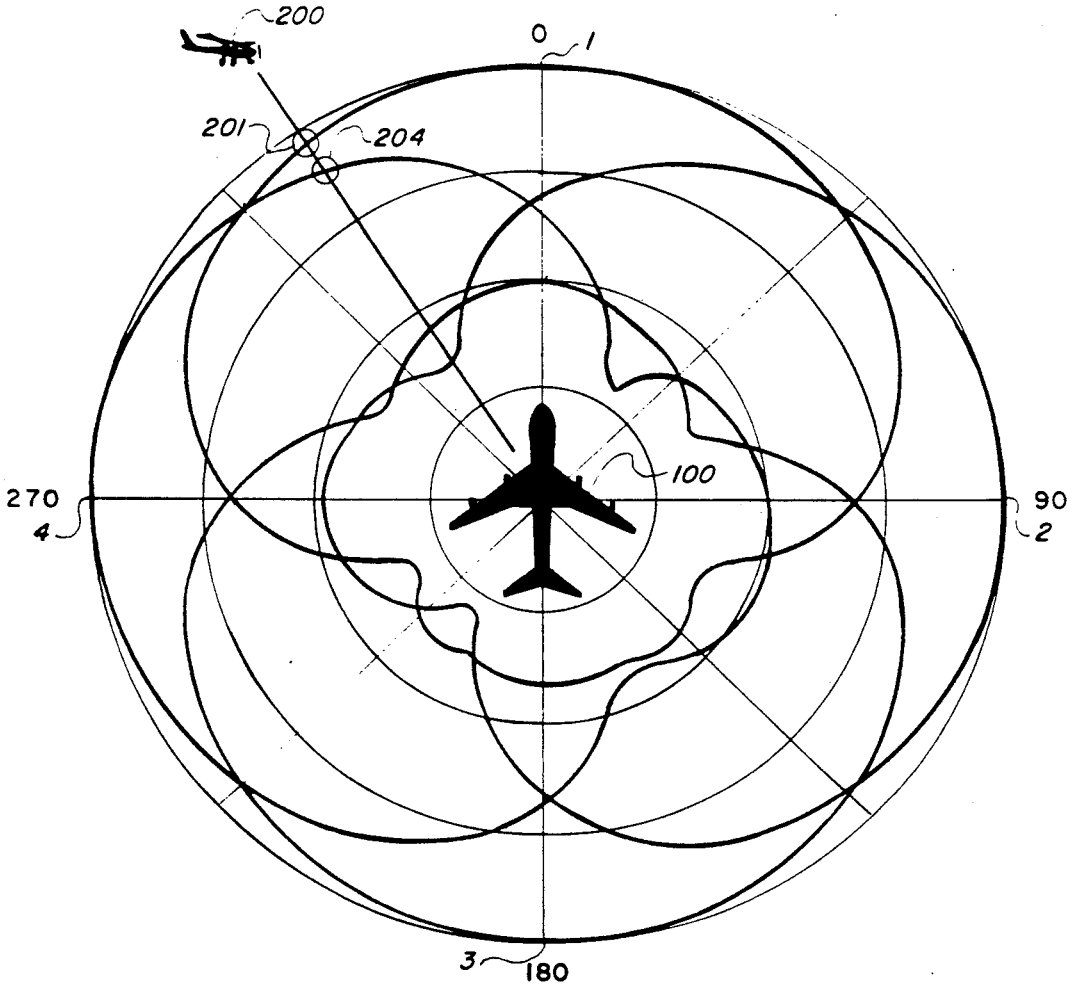
FIG. 4 is a diagram illustrating the intensity of the radiation received by the four antennas of the array as a function of angle.

Referring next to FIG. 4, the signal intensity patterns by electrical connectors 22 resulting from detection of signals by the antenna of aircraft 100 of radiation of signals from aircraft 200 is shown. Each of curves 1 (the 0° radiation lobe), 2 (the 90° radiation lobe), 3 (the 180° radiation lobe), and 4 (the 270° radiation lobe) represents a relative signal amplitude for each electrical connector as a function of angle. In the preferred embodiment, the relative signal intensity for the two electrical connectors showing the largest amplitudes is shown in FIG. 4. For example, the electrical connector having the strongest signal provides a signal intensity for radiation originating from aircraft 200 corresponding to point 201 of curve 1 (the 0° lobe), while the electrical connector having the second strongest signal provides a signal intensity illustrated by point 204 of curve 4 (the 270° lobe). By comparison of the signal intensities for the electrical connectors providing signal strengths of 201 and 204 as well as the related identity of the electrical connectors whose signals are being processed, a determination can be made that the aircraft 200 has bearing of approximately 320° relative to aircraft 100. In the transmission mode, when the antenna is activated by the activation of only one electrical connector, only one of the curves displayed in FIG. 4 is generated, thereby providing a directional radiation pattern.

Figures 5A, 5B:
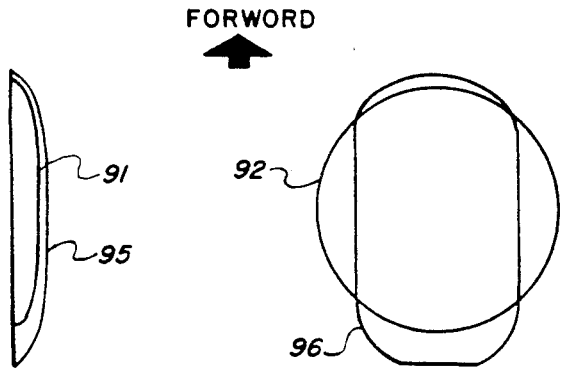
FIGS. 5A and 5B illustrate the comparison of the disk shaped radome and the surfboard shaped radome.

Referring next to FIG. 5A and FIG. 5B, the geometry for two configurations of the antenna are compared. The geometries being compared are the circular geometry and the surfboard geometry. FIG. 5A illustrates a side view for the circular configuration 91 and the surfboard configuration 95. For the side view, the circular geometry is slightly lower and shorter than the surfboard configuration. In FIG. 5B, a comparison of the top view of the two configurations illustrates that, as viewed from the forward direction, the width of the surfboard configuration 96 is smaller than the circular configuration 92. Thus, the profile (as viewed from the front of the aircraft) is smaller for the surfboard geometry than the profile for the circular geometry.

Figure 6:
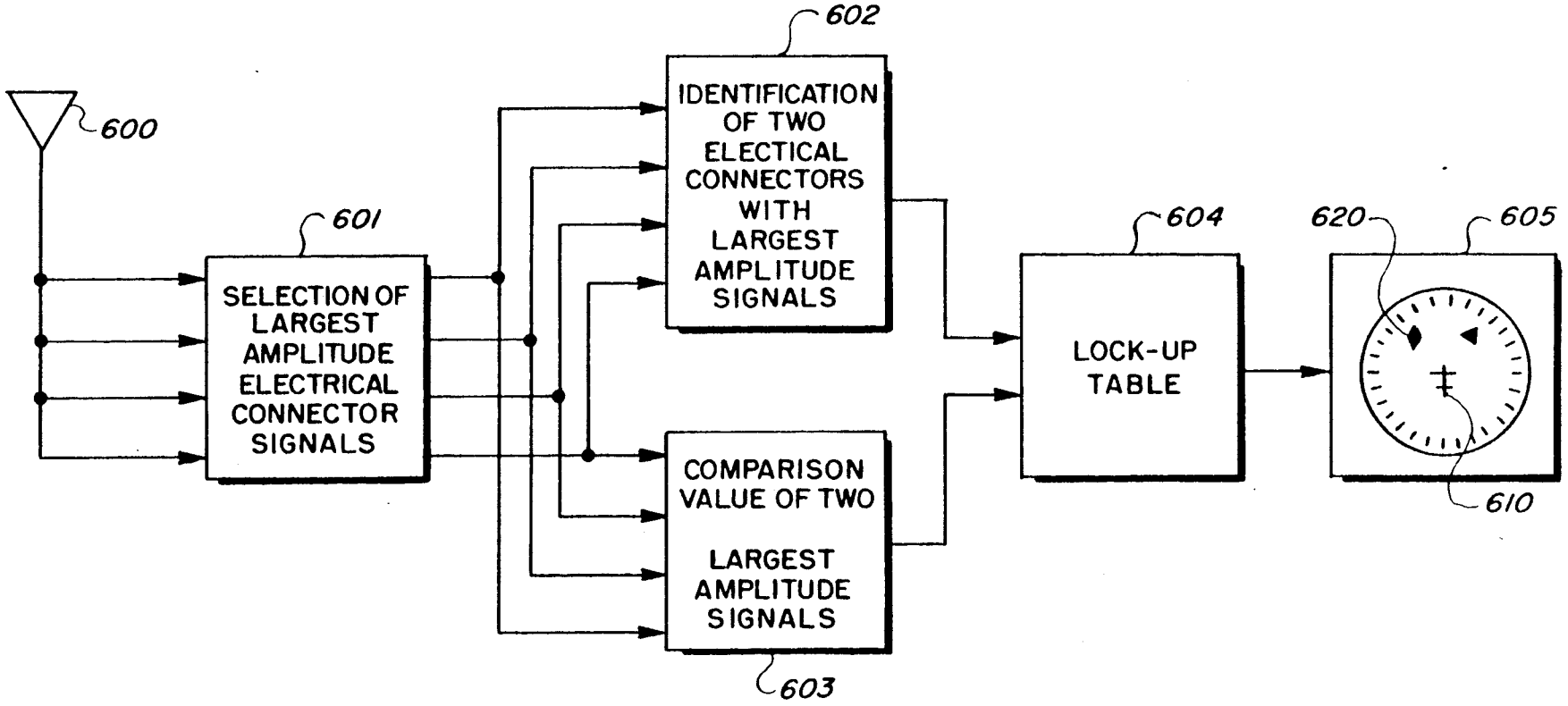
FIG. 6 is a block diagram of the apparatus for identifying the bearing of the source of radiation received by the antenna.

Referring to FIG. 6, the apparatus for conversion of signals from the antenna 600 to a display 605 of the direction of the intruder aircraft relative to the monitoring aircraft is shown. The signals from the antenna 600 are applied to apparatus for the selection of two strongest signals 601. The selected signals from selection apparatus 601 are applied to identification apparatus 602 wherein the identification of the electrical connectors having the two strongest signals is performed. The selected signals from selection apparatus 601 are also applied to comparison apparatus 603 wherein a comparison of the signal strengths of the two largest electrical connector signals is performed. The signals identifying the electrical connectors having the two largest induced signal amplitudes from identification apparatus 602 and the value of the comparison of the two largest signals from comparison apparatus 603 are applied to look-up table 604. From the look-up table a bearing or direction relative to the monitoring aircraft is provided to a display unit 605. Typically, the bearing of an intruder aircraft (i.e., intruder aircraft icon 620 on the display screen) is shown relative to the monitoring aircraft (i.e., monitoring aircraft icon 610 on the display screen) on the rate of climb indicator cockpit display. As will be clear to those skilled in the art of avionics apparatus, the signals from the electrical connectors can be converted into digital signals and processed by the TCAS system.

2. Operation of the Preferred Embodiment

The most immediate application of the present invention is to the inter-aircraft communication such as the mode S transponder communication or communication of the traffic alert and collision avoidance systems. At present, the frequencies assigned to the inter-aircraft communication of interest are 1.03 GHz and 1.09 GHz. A typical monopole antenna element is approximately 2.75" in height (in free space). The maximum overall height of the antenna of the present invention using the folded monopole configuration is 0.806". In addition, the typical antenna of the prior art has severe mutual coupling effects between the individual antenna elements. The present invention reduces the height required for the antennas by using a capacitive hat to provide a top load for each monopole antenna element. The use of a capacitive hat is known to provide for a shorter antenna while maintaining approximately the same radiation pattern. For monopole antenna elements of a length of ⅛ wavelength or less, the radiation resistance decreases monotonically for decreasing length. Therefore, by decreasing the height of the antenna element, the actual radiated power is decreased. Compensation for the decrease in radiation power by the shortened antenna is provided, in the present invention, by using a folded monopole antenna element configuration, i.e., the free (non-grounded) end of the antenna element extends in the opposite direction from the direction of the antenna at the grounded terminal. The folded antenna configuration can increase the radiation resistance (by up to a factor of 4) and can thereby increase the radiated power.

The determination of the bearing of the intruder aircraft results from the processing of induced signal amplitudes alone without the processing of induced signal phases. When the induced signal phases do not have to be processed, installation and calibration of the antenna is simplified.

In order to minimize the coupling between the individual antenna elements of the array, the conductive coating structure (19 of FIG. 1) is applied between the antenna elements. The decoupling of the antenna elements is further enhanced by the extensions of the conductive coating structure between the capacitive hats.

The physical spacing between the forward and aft antenna elements is slightly less than one-half wavelength to insure that the weakest portion of the radiation pattern is directly opposite the strongest portion. If the physical spacing between the two antenna elements were exactly one-half wavelength, the radiation pattern would have minimum intensities at azimuth angles of 90°, 180°, and 270°.

In the transmitting mode, power is introduced to the antenna by only one of the electrical connectors, thereby providing a directional radiation pattern. In the receiving mode, the signal intensities associated with each electrical connector are measured and used in the determination of the relative bearing of the intruder aircraft.

One of the advantages of the present invention is the ease of fabrication. The positioning of the antenna elements of the antenna is reproducible, the positioning depending on the structure and artwork on the radome element. The signal phase processing is performed in the beam forming network, so that additional phase dependent elements, or the apparatus for the calibration of additional phase forming elements, is not necessary.

The antenna element free portions for the radiating antenna elements extend through apertures in the beam forming circuit card assembly and the ground plate. The normal method of coupling the antennas to the beam forming network (i.e., on the beam forming circuit card assembly) would be to solder the elements together for optimum electrical contact. The thermal and pressure stresses can fracture the soldered couplings. In the present invention, a tinned, phosphor bronze contact is coupled between the antenna and the associated conducting strip of the beam forming network. This contact provides for the relief of mechanical strain between the radome and the beam forming circuit card assembly.

Because it is frequently impossible or undesirable to avoid completely electrical storms, aircraft antennas and antenna arrays must be protected in the presence of lightning. The antenna of the present invention provides lightning protection in two ways. First, the assembly has thirteen grounded fasteners exposed on the exterior of the assembly to which the lightning will be drawn. And second, the dielectric strength of the radome material reduces the risk of damage to the antenna by causing the lightning to flashover to the grounded fastener before dielectric puncture occurs. The antenna has been tested with electrical discharges and no structural damage resulted nor did the discharges couple to the antenna radiating elements.

The resistors and capacitors included in the beam forming network have a negligible effect on the operation of the antenna. However, by including resistors having different values in each branch, the resistance measured at the electrical connector terminals can be used to determine when the conductors from the aircraft processing apparatus are correctly applied to the antenna electrical connectors. The capacitors provide that the correct resistors are measured during the verification process. The resistance measurements can also be used to identify certain fault conditions, e.g., open and short circuit conditions.

The foregoing description is included to illustrate the operation of the preferred embodiment and is not meant to limit the scope of the invention. The scope of the invention is to be limited only by the following claims. From the foregoing description, many variations will be apparent to those skilled in the art that would yet be encompassed by the spirit and scope of the invention.

What is claimed is:

1. A directional antenna comprising:

a dielectric material radome having an interior surface wherein predetermined first regions of said radome interior surface are shaped to form a multiplicity of folded monopole antenna elements wherein each of said folded monopole antenna elements comprises a feed portion, a grounded portion and a capacitive hat coupling said feed portion to said grounded portion, and wherein each of said folded monopole elements further comprises an electrically conductive coating covering each of said first regions, and wherein a predetermined second region of said radome interior surface is shaped to form a decoupling element wherein said decoupling element comprises an electrically conductive coating covering said second region;

a first ground plate coupled to said folded monopole antenna element grounded portions;

a multiplicity of electrical connectors for electrically coupling said antenna to electrical apparatus;

impedance matching devices coupled to each of said antenna element feed portions; and a beam forming network electrically coupling said impedance matching devices to said electrical connectors, such that a predetermined directional radiation pattern is obtained when only one of said electrical connectors is energized in a transmit mode, and the shape of a received energy amplitude pattern for each of said connectors in a receive mode is the same as said predetermined radiation pattern, but displaced at a predetermined physical angle of rotation from those of the remaining connectors such that the direction from which a signal is received by said directional antenna may be uniquely determined by measuring only the relative amplitudes of the signals received at said electrical connectors, wherein said beam forming network includes resistances and capacitors for uniquely defining an electrical connector resistance to a DC input signal.

2. A directional antenna comprising:

a dielectric material radome having an interior surface wherein predetermined first regions of said radome interior surface are shaped to form a multiplicity of folded monopole antenna elements wherein each of said folded monopole antenna elements comprises a feed portion, a grounded portion and a capacitive hat coupling said feed portion to said grounded portion, and wherein each of said folded monopole elements further comprises an electrically conductive coating covering each of said first regions, and wherein a predetermined second region of said radome interior surface is shaped to form a decoupling element wherein said decoupling element comprises an electrically conductive coating covering said second region;

a first ground plate coupled to said folded monopole antenna element grounded portions;

a multiplicity of electrical connectors for electrically coupling said antenna to electrical apparatus;

impedance matching devices coupled to each of said antenna element feed portions; and a beam forming network electrically coupling said impedance matching devices to said electrical connectors, such that a predetermined directional radiation pattern is obtained when only one of said electrical connectors is energized in a transmit mode, and the shape of a received energy amplitude pattern for each of said connectors in a receive mode is the same as said predetermined radiation pattern, but displaced at a predetermined physical angle of rotation from those of the remaining connectors such that the direction from which a signal is received by said directional antenna may be uniquely determined by measuring only the relative amplitudes of the signals received at said electrical connectors, wherein said antenna includes four monopole antenna elements and four electrical connectors.

3. The directional antenna of claim 2 wherein at least two of said antenna elements have a physical spacing less than ½ wavelength.

* * * * *